US007424817B2

(12) United States Patent
Ishikawa et al.

(10) Patent No.: US 7,424,817 B2
(45) Date of Patent: Sep. 16, 2008

(54) METHOD OF WORKING RECESSED PORTION IN HEADREST STAY AND PRESS APPARATUS FOR WORKING RECESSED PORTION IN HEADREST STAY

(75) Inventors: Hiyoshi Ishikawa, Aichi (JP); Shigeki Eguchi, Aichi (JP)

(73) Assignees: Inoac Corporation, Aichi (JP); Arai Seisakusho Co., Ltd., Aichi (JP)

( * ) Notice: Subject to any disclaimer, the term of this patent is extended or adjusted under 35 U.S.C. 154(b) by 559 days.

(21) Appl. No.: 10/626,739

(22) Filed: Jul. 25, 2003

(65) Prior Publication Data

US 2005/0016248 A1 Jan. 27, 2005

(51) Int. Cl.
*B21D 17/00* (2006.01)

(52) U.S. Cl. ..... 72/370.21; 72/214; 72/220; 29/897.2; 29/893.32

(58) Field of Classification Search ..... 29/893.32, 29/897.2; 72/214, 220, 370.21
See application file for complete search history.

(56) References Cited

U.S. PATENT DOCUMENTS 2,825,962 A * 3/1958 Brown et al. ..... 72/370.21
6,170,313 B1 * 1/2001 Vasseur et al. ..... 72/312
6,505,493 B2 * 1/2003 Nakane et al. ..... 72/370.21
2005/0034499 A1 * 2/2005 Matsumoto ..... 72/214

FOREIGN PATENT DOCUMENTS

| | | | |
|---|---|---|---|
| JP | 43-14120 | * | 6/1968 |
| JP | 2002-137673 | * | 1/2000 |
| JP | 2002-210519 | * | 12/2001 |
| JP | 2002-137673 | * | 5/2002 |
| JP | 2004-291085 | * | 7/2003 |

* cited by examiner

*Primary Examiner*—Dmitry Suhol
(74) *Attorney, Agent, or Firm*—Sughrue Mion, PLLC

(57) ABSTRACT

In a method of working a recessed portion 2 in a headrest stay 32 which is provided in the stay portion 32 of the headrest stay 3 formed of a pipe, a recess 2' is preformed by pressing against the stay portion 32 an outer peripheral portion 4*a* of a first punch roller 4 for preforming having a rounded portion 47 on the outer peripheral portion 4*a* in a side view. Subsequently, an outer peripheral portion 7*a* of a second punch roller 7 on the outer periphery portion 7*a* of which a punch portion for final forming has been formed is directed toward and pressed against the recess 2', so as to form a recessed portion 2.

1 Claim, 16 Drawing Sheets

51(5X)
4a(4X)
52
R
52
4a(4Y)
51(5Y)
32
2'
123
O
111
12
11(1)

51(5X)
4X
52
R
2'
32(3)
52
4Y
51(5Y)
123
111
12
11(1)

51(5X)
52
4a(4X)
52
4Y
51(5Y)
123
111
12
11(1)

81(8X)
7a(7X)
82
7a(7Y)
81(8Y)
R
23(2)
O
611(32)
623
62
61(6)
32(3)
611
7Y

METHOD OF WORKING RECESSED PORTION IN HEADREST STAY AND PRESS APPARATUS FOR WORKING RECESSED PORTION IN HEADREST STAY

BACKGROUND OF THE INVENTION

The present invention relates to a method of working a recessed portion in a headrest stay which is installed on an upper end of a seatback of an automotive vehicle, as well as a press apparatus for working a recessed portion in a headrest stay.

A headrest S installed on an upper end of a seatback of an automobile or the like is provided with a plurality of recessed portions 2 for height adjustment in a stay portion 32 of a headrest stay 3 at predetermined intervals (FIGS. 14 and 15). In the drawings, reference numeral 2*a* denotes a recessed portion for preventing the headrest from coming off; 2*b*, a retaining recessed portion; 31, an insert portion; and P, a pillow portion. In recent years, for the purpose of lightweight a pipe is extensively used as the headrest stay 3 which is built into the headrest S. These recessed portions 2 have hitherto been formed by such as (1) a cutting method including milling and broaching and (2) a method based on press working.

However, the recessed portions of the stay for the headrest using a pipe as its basic material function to adjust and hold the vertical position of the headrest, and have naturally been required to satisfy predetermined strength. In the case where the recessed portions are worked by the cutting method (1), it has been necessary to use a thick-walled pipe so that even those portions where the wall thickness is smallest would be able to maintain the predetermined strength (FIG. 16A). Also in a case where those portions that are to be recessed by milling or broaching are subjected in advance to preliminary recessing, it has been necessary to secure the predetermined thickness at the portions where the wall thickness is smallest (FIG. 16B).

Meanwhile, in the case where recessed portions are formed by being removed by press working in the method (2), large burrs occur due to the wear and the like of a punch, incurring cost in their grinding (FIG. 16C). Further, fractured surfaces are rugged, and it has been difficult to obtain sharp edges necessary as the function of the recessed portions. In addition, with the method in which the pipe is held by a die and is merely pressed in from above by a punch, it has been difficult to form sharp shapes owing to the characteristics of the pipe. As a result, edge rounding has occurred, as shown in FIG. 16D. Hence, there has been a drawback in that the stopper function cannot be demonstrated due to the edge rounding in press working, causing the headrest to come off the upper end of the seatback.

SUMMARY OF THE INVENTION

The present invention is devised to overcome the above-described problems, and its object is to provide a method of working a recessed portion in a headrest stay and a press apparatus for working a recessed portion in a headrest stay, which make it possible to secure predetermined strength and easily obtain a recessed portion having a sharp shape without unnecessarily enlarging the wall thickness of the pipe.

To attain the above object, the gist of the invention according to aspect 1 lies in a method of working a recessed portion in a headrest stay which is provided in a stay portion of the headrest stay formed of a pipe, characterized by comprising the steps of: preforming a recess by pressing against the stay portion an outer peripheral portion of a first punch roller for preforming having a rounded portion on the outer peripheral portion in a side view; and directing toward and pressing against the recess an outer peripheral portion of a second punch roller on the outer periphery portion of which a punch portion for final forming has been formed, so as to form a recessed portion. Here, the first and second punch rollers may be rotatively driven appropriately apart from being rotatably attached.

The method of working a recessed portion in a headrest stay according to aspect 2 of the invention is characterized in that, in aspect 1, a pair of the first punch rollers are arranged at positions above and below the stay portion, either one of the first punch rollers located at the positions above and below is pressed against the stay portion to start the working of the recess, the working of the recess is subsequently stopped short of traversing the stay portion, the first punch roller is retracted, and another one of the first punch rollers is then pressed against the stay portion partially provided with the working of the recess, so as to effect the preforming of the recess.

The gist of the invention according to aspect 3 lies in a press apparatus for working a recessed portion in a headrest stay, characterized by comprising: a first press (A) including a first fixed die capable of placing therein a headrest stay formed of a pipe, a first punch roller having a rounded portion on an outer peripheral portion thereof in a side view, and a first movable die to which the first punch roller is rotatably attached and which is capable of advancing and retracting, wherein a recess is formed by pressing the outer peripheral portion of the first punch roller against the stay portion of the headrest stay; and a second press (B) including a second fixed die capable of placing therein a headrest stay in which the recess has been formed by the first press, a second punch roller having a punch portion for final forming formed on an outer peripheral portion thereof, and a second movable die to which the second punch roller is rotatably attached and which is capable of advancing and retracting, wherein a recessed portion is formed by directing toward and pressing against the recess the outer peripheral portion of the second punch roller.

If the recess or the recessed portion is formed by pressing the outer peripheral portion of the first or second punch roller against the stay portion as in the invention of aspects 1 to 3, a resultant force of the centrifugal force due to the rotation of the punch roller and the pressing force of the press is directed toward the central portion of the pipe. Therefore, forming is possible without producing chips. Since the recessed portion is formed by plastic working unlike cutting work, the thickness of the portion of the recessed portion is not reduced, and the strength of that portion is maintained in the same way as the remaining portion. Then, the recess is preformed, the outer peripheral portion of the second punch roller on the outer periphery portion of which the punch portion for final forming has been formed is directed toward and pressed against the recess, so as to form the recessed portion in two separate stages. Therefore, it is possible to work a recessed portion having a desired sharp shape.

Further, as in the invention of aspect 2, the pair of the first punch rollers are arranged, and either one of them is pressed against the stay portion to start the working of a recess. Subsequently, the working of the recess is stopped short of traversing the stay portion, and the first punch roller is retracted. Then, another one of the first punch rollers is pressed against the stay portion partially provided with the working of the recess, so as to effect the preforming of the recess. If this arrangement is provided, the working of a recess of more stable quality is made possible. A protruded portion formed by the first punch roller is allowed to stay on the recess, and the other first punch roller is made to advance from the opposite direction to effectively push the protruded portion into the pipe interior in plastic deformation working. Hence, no burrs and the like occur.

To attain the above object, the gist of the invention according to aspect 1 lies in a method of working a recessed portion in a headrest stay which is provided in a stay portion of the headrest stay formed of a pipe, characterized by comprising the steps of: preforming a recessed portion by pressing a punch against the stay portion while rotating the punch; and forming the recessed portion by press working using a press punch.

The gist of the invention according to aspect 202 lies in a method of working a recessed portion in a headrest stay which is provided in a stay portion of the headrest stay formed of a pipe, characterized by comprising the steps of: setting the headrest stay on a holder by exposing a portion of the stay portion where the recessed portion is to be provided; preforming a recessed portion by pressing against the stay portion a disk-shaped punch in which a side-view shape of an outer peripheral portion thereof is made similar to that of the recessed portion while rotating the punch; fitting a holder cover on the holder; and forming the recessed portion by press working using a press punch.

DETAILED DESCRIPTION OF THE PREFERRED EMBODIMENTS

Hereafter, a detailed description will be given of a method of working a recessed portion in a headrest stay and a press apparatus for working a recessed portion in a headrest stay in accordance with the invention.

(1) First Embodiment

Figure 1:
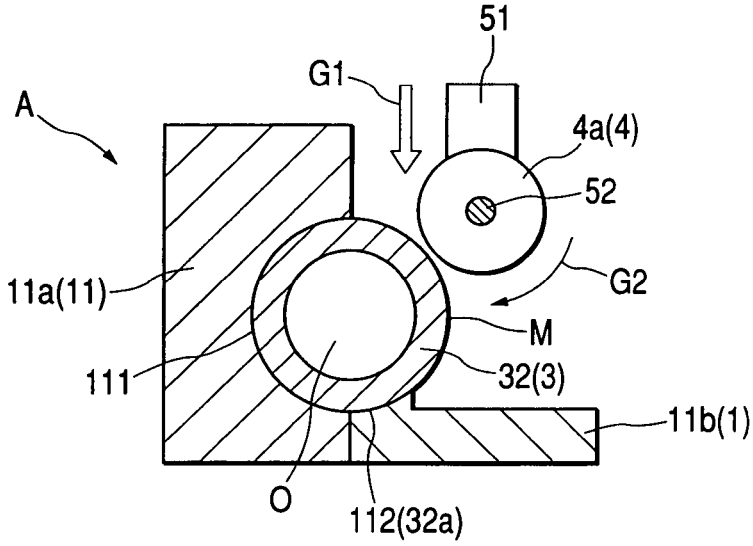
FIG. 1 is an explanatory cross-sectional view of a first press for a first step in a press apparatus for working a recessed portion in a headrest stay in accordance with a first embodiment.
Figure 2A:
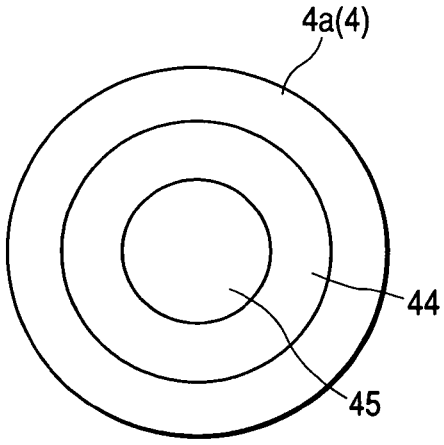
FIGS. 2A and 2B are enlarged views of a first punch roller shown in FIG. 1.
Figure 2B:
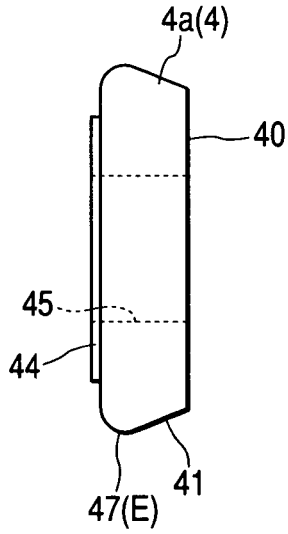
Figure 3A:
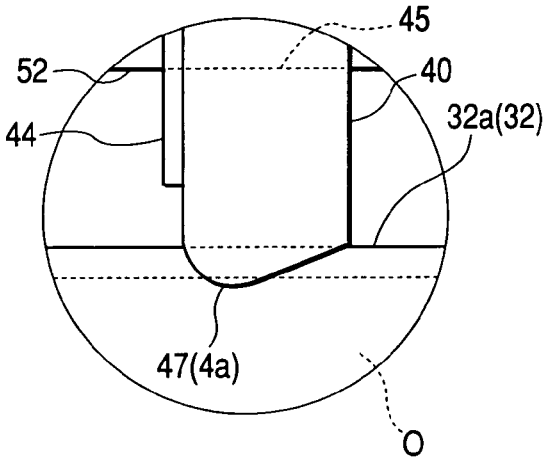
FIG. 3A is a plan view illustrating the positional relationship between the first punch roller and a stay portion before preforming.
Figure 3B:
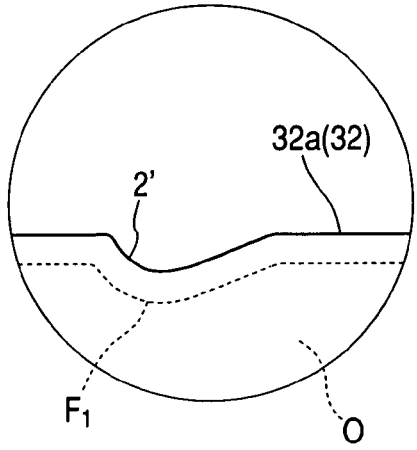
FIG. 3B is an enlarged view of a recessed portion and its vicinity after preforming.
Figure 4:
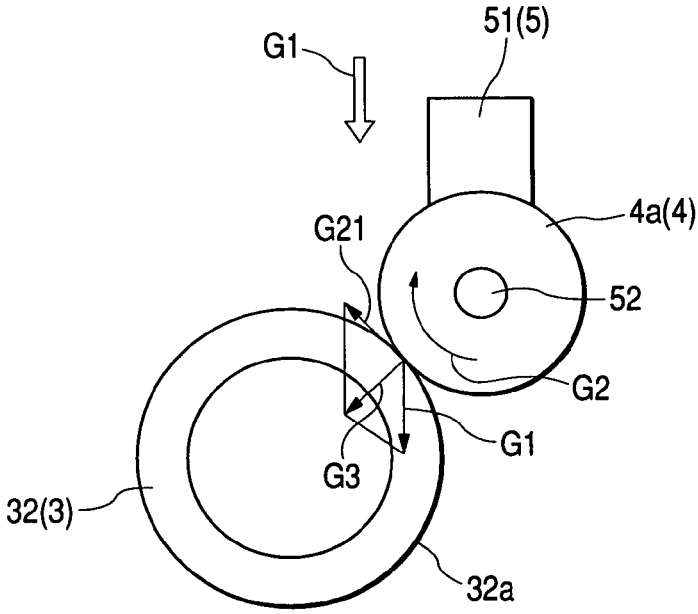
FIG. 4 is an explanatory diagram illustrating the direction of a resultant force produced by the centrifugal force relating to the rotating force and by the pressing force in a case where the rotating punch roller is pressed and lowered against the stay portion.
Figure 5A:
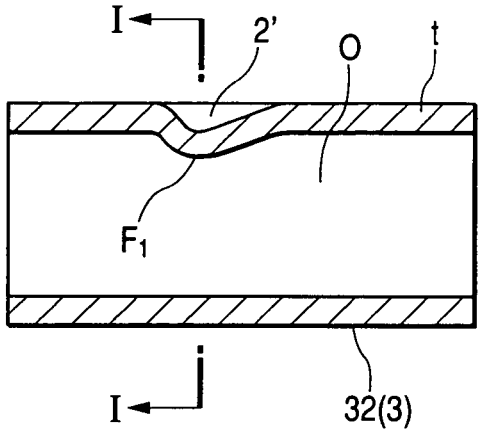
FIG. 5A is a longitudinal sectional view of the stay portion at the recess and its vicinity.
Figure 5B:
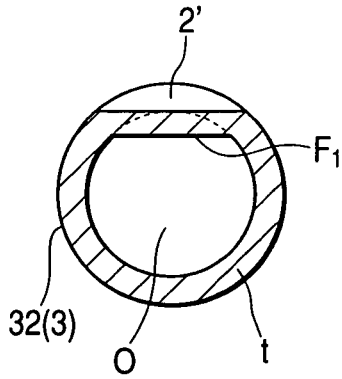
FIG. 5B is a view taken in the direction of arrows along line I-I in FIG. 5A.
Figure 6:
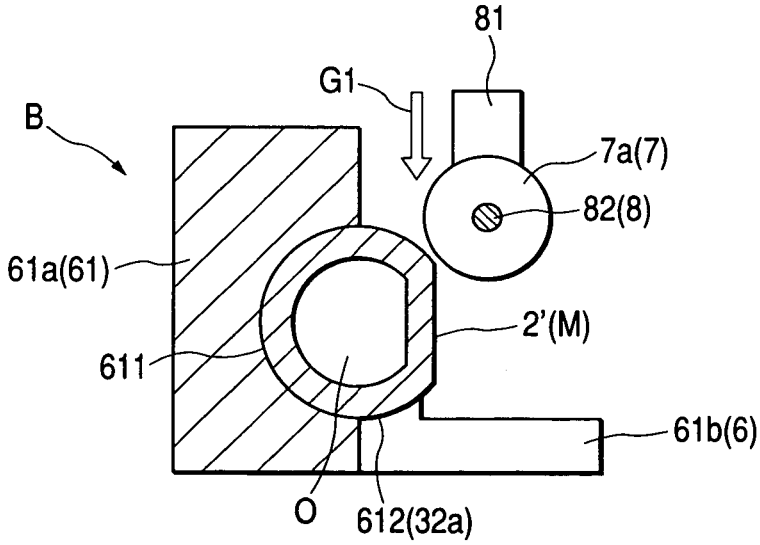
FIG. 6 is an explanatory sectional view of a second press B for a second step.

FIGS. 1 to 9 show one mode of the method of working a recessed portion in a headrest stay and the press apparatus for working a recessed portion in a headrest stay in accordance with the invention. FIG. 1 is an explanatory cross-sectional view of a first press for a first step. FIGS. 2A and 2B are enlarged views of a first punch roller shown in FIG. 1. FIG. 3A is a plan view illustrating the positional relationship between the first punch roller and a stay portion before preforming. FIG. 3B is an enlarged view of a recessed portion and its vicinity after preforming. FIG. 4 is an explanatory diagram illustrating the direction of a resultant force produced by the centrifugal force relating to the rotating force and by the pressing force in a case where the rotating punch roller is pressed and lowered against the stay portion. FIG. 5A is a longitudinal sectional view of the stay portion at a recess and its vicinity. FIG. 5B is a view taken in the direction of arrows along line I-I in FIG. 5A. FIG. 6 is an explanatory sectional view of a second press for a second step. FIGS. 7A and 7B are enlarged views of a second punch roller shown in FIG. 6. FIG. 8A is a plan view illustrating the positional relationship between the second punch roller and the recess before the formation of the recessed portion. FIG. 8B is an enlarged view of the recessed portion and its vicinity after the formation of the recessed portion. FIG. 9A is a longitudinal sectional view of the stay portion at the recessed portion and its vicinity. FIG. 9B is a view taken in the direction of arrows along line II-II in FIG. 9A.

1-1. Press Apparatus for Working a Recessed Portion

Prior to the method of working a recessed portion in a headrest stay in accordance with the invention, a description will be first given of a press apparatus for working a recessed portion which is used in this method. The press apparatus for working is comprised of a first press A and a second press B (FIGS. 1 and 6).

The first press A is comprised of a first fixed die 1, a first punch roller 4, and a first movable die 5. The first fixed die 1 here is constituted by a holder 11 which is a lower die for holding and fixing a headrest stay 3, and includes two split dies 11*a* and 11*b*. The left split die 11*a* in FIG. 1, in which a cavity 111 of a semicircular section has been formed, holds the left split portion of a stay portion 32. The stay portion 32 fitted in the left split die is subsequently fitted and fixed in the holder 11 as the plate-shaped right split die 11*b* is closed, as shown in FIG. 1. It should be noted that, at the time of working a recess, the portion of an insert portion 31 of the headrest stay 3 which is not subject to working is also appropriately fixed by an unillustrated clamping tool or the like.

When the left and right split dies 11*a* and 11*b* are closed, the holder 11 assumes an L-shaped cross section, as shown in the drawing. Further, an upper left surface of the right split die 11*b,* which forms a circular arc-shaped surface 112, is brought into close contact with a peripheral surface 32*a* of the stay, allowing the stay portion 32 to be reliably held by the holder 11. At this stage, the portion (right-hand portion) of the stay portion 32 where a recessed portion 2 is provided is exposed. Thus, even if the headrest stay 3 is thus set in the holder 11, it becomes possible to effect the preforming of the recessed portion 2 by the first punch roller 4 in the first step.

The aforementioned first punch roller 4 is a disk-shaped roller whose side-view shape of its outer peripheral portion 4*a* resembles that of the recessed portion 2, and a shaft hole 45 is formed in the center of the roller. In this first punch roller 4, unlike the recessed portion 2 of the finally worked shape, a rounded portion 47 is formed at the portion of the outer peripheral portion 4*a* corresponding to a corner portion of the recessed portion 2.

Figure 8A:
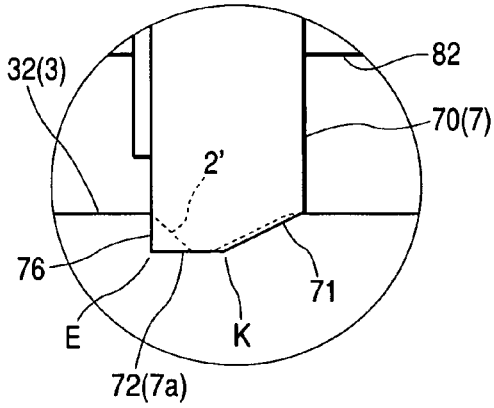
FIG. 8A is a plan view illustrating the positional relationship between the second punch roller and the recess before the formation of the recessed portion.
Figure 8B:
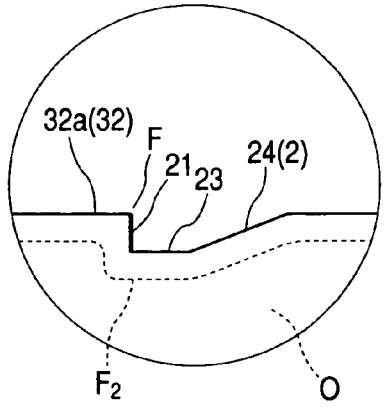
FIG. 8B is an enlarged view of the recessed portion and its vicinity after the formation of the recessed portion.

FIG. 2A is a front elevational view of the first punch roller 4, and FIG. 2B is a side elevational view of the first punch roller 4. A side-view shape for forming a recess 2', which is similar to the shape of the recessed portion to be finally obtained, but is smooth and has the rounded portion 47, is secured on the outer peripheral portion 4*a* of the first punch roller 4. An inclined surface 41 corresponding to an inclined surface 24 of the recessed portion 2 is provided on the outer peripheral portion 4*a* of the first punch roller, and the rounded portion 47 with a circular arc-shaped surface corresponding to a bottom surface 23 of the recessed portion and an upright surface 21 is also provided thereon (FIGS. 2, 8A, and 8B). At an edge portion F where the upright surface 21 drops from the outer peripheral surface 32*a* of the stay portion, there is a falling portion of the upright surface which corresponds thereto, but the falling portion is formed into a gentle shape. In addition, the portion of the outer peripheral portion of the first punch roller that corresponds to an intersection between the bottom surface 23 of the recessed portion and the inclined surface 24 also depicts a gentle curved surface.

The first punch roller 4 is rotatably attached to the first movable die 5, and the first movable die 5 is capable of advancing and retracting the first punch roller 4. As the first movable die 5 advances toward the first fixed die 1, the first movable die 5 is adapted to form the recess 2' by pressing the stay portion 32 of the headrest stay placed on the first fixed die 1. Specifically, as a supporting shaft 52 of a first-punch-roller mounting tool 51, which is a portion of the first movable die 5 (here, an upper die), is inserted in the shaft hole 45 of the first punch roller 4, the first punch roller 4 is rotatably supported by the punch-roller mounting tool 51. The first-punch-roller mounting tool 51 normally stays on standby at a position above that portion of the stay portion 32 (which has been set in the holder 11) where the recessed portion 2 is provided. Then, after the first-punch-roller mounting tool 51 is lowered and the first punch roller 4 is set in a rotatable state, the stay portion 32 is pressed by the first punch roller 4, thereby permitting the preforming of the recess 2'.

The second press B is a press working apparatus which is comprised of a second fixed die 6, a second punch roller 7, and a second movable die 8, and is capable of forming the recessed portion 2 (FIG. 6). The second press B differs only in the shape of the second punch roller 7, and in the other aspects has the same basic construction as the first press A. The second fixed die 6 is a lower die capable of mounting the headrest stay 3 in which the recess 2' has been formed by the first press A. A holder 61, which is the lower die for holding and fixing the headrest stay 3, is constituted by two split dies 61*a* and 61*b*. The second fixed die 6 is identical to the first fixed die 1 in shape and the like, so that a detailed description thereof will be omitted.

The second punch roller 7 is a disk-shaped roller in which a punch portion for final forming has been formed on its outer peripheral portion 7*a,* and a shaft hole 75 is formed in the center of the roller.

Figure 7A:
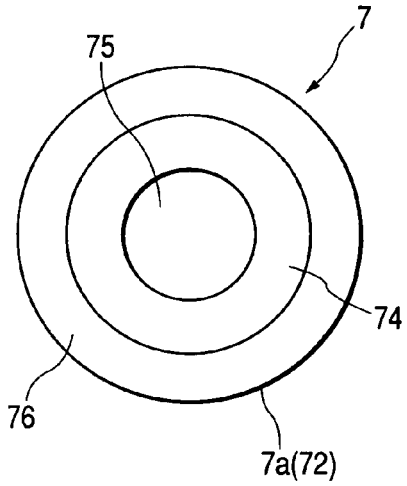
FIGS. 7A and 7B are enlarged views of a second punch roller shown in FIG. 6.
Figure 7B:
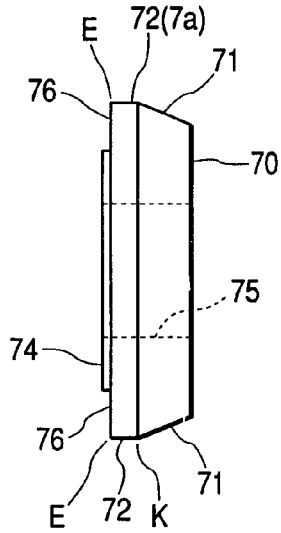

FIG. 7A is a front elevational view of the second punch roller 7, and FIG. 7B is a side elevational view of the second punch roller 7. A side-view shape which virtually conforms to the shape of the recessed portion 2 to be finally obtained is secured on the outer peripheral portion 7*a* of the second punch roller 7. An inclined surface 71 corresponding to the inclined surface 24 of the recessed portion 2 is provided on the outer peripheral portion 7*a* of the second punch roller. Further, a flat surface 72 corresponding to the bottom surface 23 of the recessed portion is also provided thereon. Furthermore, a vertical portion 76 corresponding to the upright surface 21 is provided. A right-angled portion E in a side view is formed at the portion of the outer peripheral portion 7*a* of the second punch roller corresponding to the right-angled portion where the bottom surface 23 of the recessed portion and the upright surface meet. A bent point K is formed at the portion where the inclined surface 71 and the flat surface 72 meet.

The second punch roller 7 is rotatably attached to the second movable die 8, and the second movable die 8 is capable of advancing and retracting the second punch roller 7. As the second movable die 8 advances toward the second fixed die 6, the second movable die 8 is adapted to form the recessed portion 2 by pressing against the recess 2' of the headrest stay 3 placed on the second fixed die 6. As a supporting shaft 52 of a punch-roller mounting tool 81, which is a portion of the second movable die 8, is inserted in the shaft hole 75 of the second punch roller 7, the second punch roller 7 is rotatably supported by the punch-roller mounting tool 81. The punch-roller mounting tool 81 normally stays on standby at a position above that portion of the stay portion 32 (which has been set in the holder 61) where the recess 2' is located. Then, after the punch-roller mounting tool 81 is lowered and the second punch roller 7 is set in a rotatable state, the stay portion 32 is pressed by the second punch roller 7, thereby permitting the forming of the recessed portion 2. The second movable die 8 is also identical to the first movable die 5 in the basic construction.

A detailed description has been given above of the first press A and the second press B, but these two presses may be constructed separately or may be integrally incorporated in one press machine apparatus. Either construction falls within the range of the invention.

1-2. Method of Working a Recessed Portion in the Headrest Stay 3

In the method of working a recessed portion in the headrest stay 3, the headrest stay 3 formed of a pipe is first set in the holder 11 (FIG. 1). After the left and right split dies 11*a* and 11*b* are opened, and the stay portion 32 is fitted, the stay portion 32 is fixed and set by closing the dies. At this time, the right half portion of the stay portion 32 which is a portion M where the recessed portion 2 is to be provided is in an exposed state.

Next, the punch-roller mounting tool 51 is lowered against the recessed-portion forming portion M of the stay portion 32. As the first punch roller 4 is lowered toward the recessed-portion forming portion M perpendicularly to the longitudinal direction of the stay portion 32, the preforming of the recess 2' is effected (FIGS. 3A and 3B). After the first punch roller 4 jutting out from the mounting tool is set in a rotatable state, the first punch roller 4 is pressed against the stay portion 32 to effect the preforming of the recess 2'. The first punch roller 4 is rotatably attached to the supporting shaft 52, as already mentioned. Accordingly, if the first punch roller 4 is lowered, the first punch roller 4, while rotating, presses the stay portion 32, thereby making it possible to effect plastic working in which unnecessary deformation of the pipe (stay portion 32) is suppressed.

Here, the rotating first punch roller 4 applies a force in the direction in which a pipe wall t is pressed toward a pipe interior O. As shown in FIG. 4, a resultant force G3 of a force G1 acting in the direction of the open arrow in which the first punch roller 4 is lowered and a force G2 with which the first punch roller 4 rotates clockwise in the direction of the solid arrow while rubbing against and rolling on the stay portion 32, acts to apply a force in the direction in which the pipe wall t is pressed toward the pipe interior O, thereby forming the recess 2'. When the force G1 for lowering the first punch roller 4 and a centrifugal force G21 relating to the clockwise rotating force G2 of the first punch roller 4 are applied to the recessed-portion forming portion M, the resultant force G3 thereof becomes a force which tends to enter the pipe interior. To give a more detailed description, since the first punch roller 4 rotates to generate the force G2 in synchronism with the pressing force G1 acting in the direction of the open arrow, the direction of the resultant force G3 of the first punch roller 4 at the peripheral surface at the recessed-portion forming portion M of the stay portion 32 is considered to substantially pass the central axis of the pipe. If the first punch roller 4 is fixed to the mounting tool 51 so as not to rotate, cracks or large deformation can occur in the recessed-portion forming portion, and deformation occurs in the stay portion 32 as well, rendering forming impossible. Therefore, it is extremely effective to preform the recess 2' by setting the first punch roller 4 in a rotatable state. It should be noted that the hatching of the pipe section of the stay portion 32 is omitted in FIG. 4.

Since the outer peripheral portion 4*a* of the first punch roller 4 is pressed against the stay portion 32, the force G3 which is directed toward the pipe interior is applied to the pipe 32 (FIG. 4). However, since the interior of the pipe is hollow at O, the force is satisfactorily dodged and absorbed while denting the pipe toward the pipe interior. The pipe wall t need not be shaved off, and no apprehension is caused over the occurrence of cracks or the like in the basic material of the pipe. Thus, when the first punch roller 4 which is rotating while being pressed against the stay portion 32 passes that recessed-portion forming portion M, the preformed recess 2' is formed, as shown in FIGS. 5A and 5B. As the recess 2' is formed, a bulged portion F1 is formed on the inner peripheral side of the stay portion 32 at the recessed-portion forming portion M.

As for the outer peripheral portion of the first punch roller 4, a side-view shape which is slightly smaller than that of the recessed portion 2 is adopted, and the recess 2' which is close to the recessed portion 2 is obtained, as shown in FIGS. 8A and 8B. It is desirable for the recess 2' to be as close to the shape of the recessed portion 2 as possible within the range in which the defective deformation W at the time of formation of the recess 2' is suppressed. The smaller the portion of correction from the recess 2' to the recessed portion 2, the more satisfactory result can be obtained.

When the aforementioned recess 2' has been formed, the first punch roller 4 is retracted. Subsequently, the headrest stay 3 in which the recess 2' has been formed is set in the second press B described above. After the left and right split dies 61*a* and 61*b* are opened, and the stay portion 32 is fitted, the stay portion 32 is fixed and set by closing the dies in a state in which the portion where the recess 2' is present is set in an exposed state (FIG. 6).

Next, the second punch roller 7 in which the punch portion for final forming has been formed on its outer peripheral portion is set in a rotatable state. Then the outer peripheral portion of the second punch roller 7 jutting out from the mounting tool is directed toward and pressed against the recess 2' so as to form the recessed portion 2 (FIG. 6).

The second punch roller 7 is lowered toward the recess 2' perpendicularly to the longitudinal direction of the stay portion 32, thereby forming the recessed portion (FIGS. 8A and 8B). Since the second punch roller 7 is rotatably attached to the supporting shaft, if the second punch roller 7 is lowered, the second punch roller 7, while rotating on the stay portion 32, presses the stay portion 32 around the recess 2', and thereby effects the plastic working of the recessed portion 2.

Here again, the second punch roller 7 applies a force in the direction in which the pipe wall t is pressed toward the pipe interior O. In the same way as the first punch roller 4 shown in FIG. 4, the resultant force G3 of the force G1 acting in the direction of the open arrow and the centrifugal force G21 relating to the force G2 with which the second punch roller 7 rotates clockwise in the direction of the solid arrow while rubbing against and rolling on the stay portion 32, acts to apply a force in the direction in which the pipe wall t is pressed toward the pipe interior O, thereby forming the recessed portion 2. It has been confirmed that it is extremely effective to form the recessed portion by also setting the second punch roller 7 in a rotatable state.

Figure 9A:
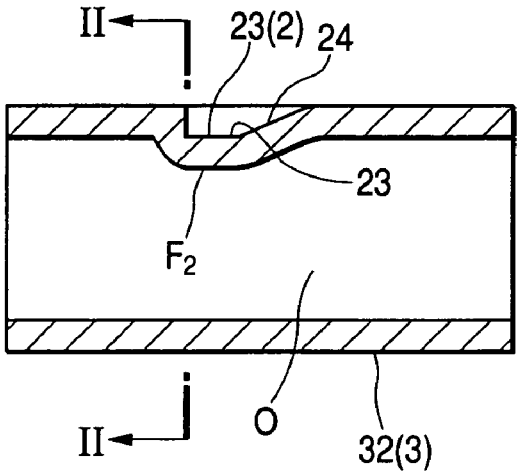
FIG. 9A is a longitudinal sectional view of the stay portion at the recessed portion and its vicinity.
Figure 9B:
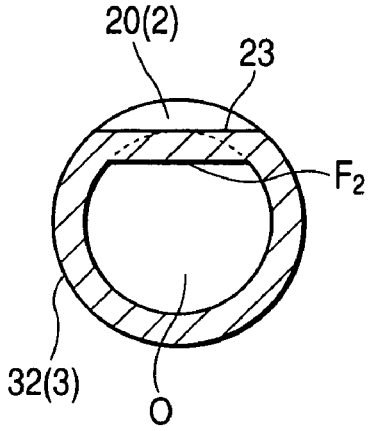
FIG. 9B is a view taken in the direction of arrows along line II-II in FIG. 9A.

Since the outer peripheral portion 7*a* of the second punch roller 7 is pressed against the stay portion 32, the force G3 which is directed toward the pipe interior in the same way as FIG. 4 is applied to the pipe 32. However, since the interior of the pipe is hollow at O, in this stage as well, the force is satisfactorily dodged and absorbed while denting the pipe toward the pipe interior. Thus, when the second punch roller 7 which is rotating while being pressed against the stay portion 32 passes the recess 2', the desired recessed portion 2 is formed, as shown in FIGS. 9A and 9B. As the recessed portion 2 is formed, a bulged portion F2 is formed on the inner peripheral side of the stay portion 32.

Incidentally, it is also conceivable to omit the forming of the recess 2' by the first punch roller 4 and to form the recessed portion 2 at a stroke by the second punch roller 7 from the outset so as to save labor. However, if the recessed portion 2 is formed at a stroke by the second punch roller 7, the large defective deformation W occurs at the time of formation of the recess 2', and cracks and the like occur in some cases. Thus it is difficult to form a satisfactory recessed portion 2. It has been experimentally confirmed that the quality stabilizes if the two-stage method is adopted in which the recess 2' close to the recessed portion 2 is formed in advance, and the recessed portion 2 to be obtained finally is subsequently formed.

(2) Second Embodiment

Figure 10:
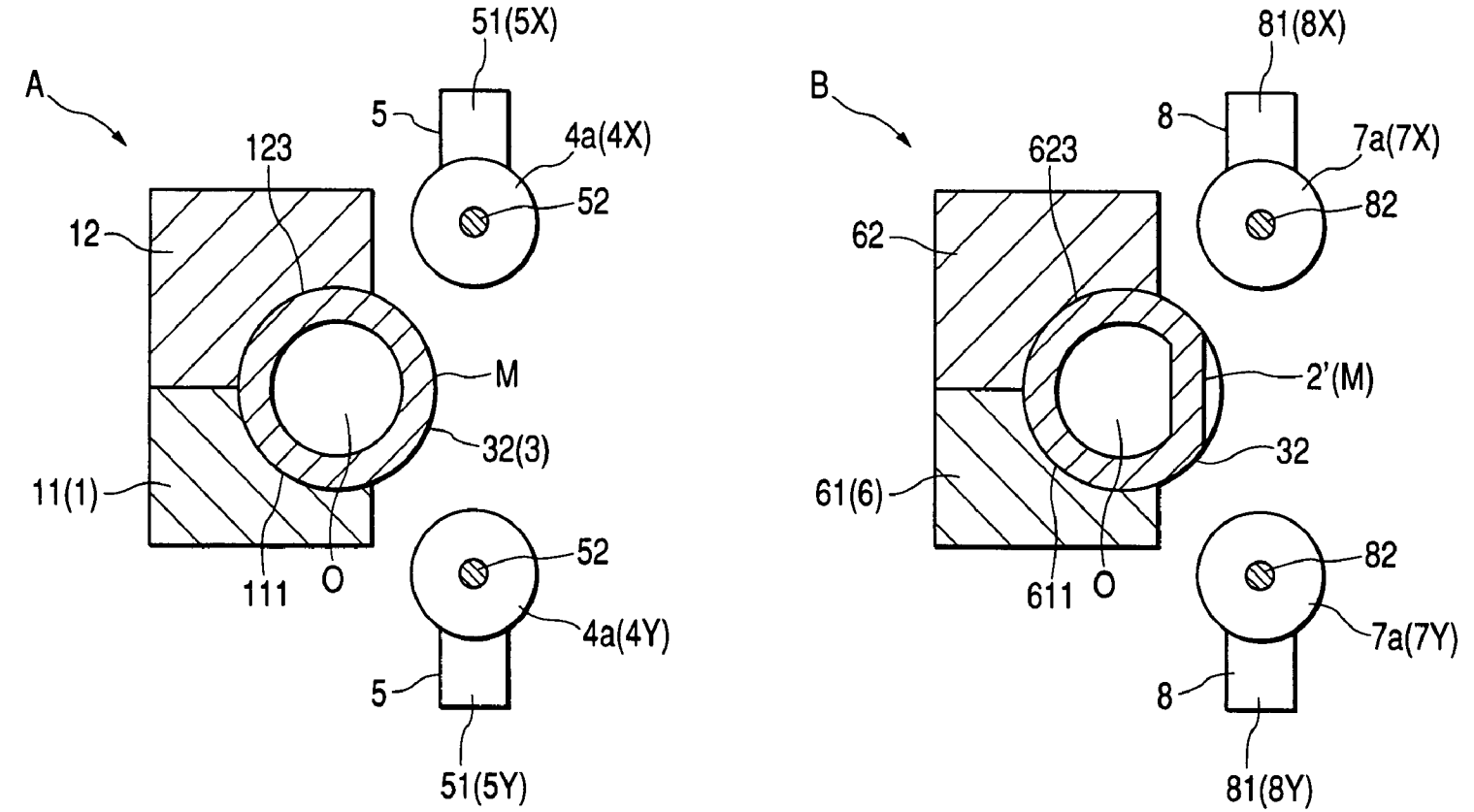
FIG. 10 is an explanatory cross-sectional view of a press apparatus for working a recessed portion in a headrest stay in accordance with a second embodiment.

As shown in FIG. 10, in the press apparatus for working a recessed portion in the headrest stay 3 in this embodiment, the first press A is comprised of the first fixed die 2, two first punch rollers 4, and two first movable dies 5, while the second press B is comprised of the second fixed die 6, two second punch rollers 7, and two first movable dies 8. The first fixed die 1 includes the holder 11 corresponding to the holder split die 11*a* of the first embodiment, as well as a holder cover 12 for holding and fixing the headrest stay 3 by being fitted on the holder 11 from above. In the same way as the first fixed die, the second fixed die 6 also includes the holder 61 and a holder cover 62. Although the first and second fixed dies 1 and 6 are different in shape from the first embodiment, but the headrest stay 3 can be placed and fixed therein in a state in which the portion where the recessed portion 2 is to be provided is exposed. The shapes and structures of the other component elements, i.e., the first punch roller 4, the first movable die 5, the second punch roller 7, and the second movable die 8, are identical to those of the first embodiment, so that a description thereof will be omitted.

Two first punch rollers 4X and 4Y are respectively attached to first movable dies 5X and 5Y so as to oppose each other in a state in which the stay portion 32 in a set state is placed at a substantially intermediate position. The arrangement provided is such that the first movable die 5Y with the first punch roller 4Y is additionally provided for the first press A of the first embodiment at a position below the stay portion 32 in the set state. Two second punch rollers 7X and 7Y are also respectively attached rotatably to second movable dies 8X and 8Y. If the stay portion 32 in which the recess 2' has been formed is set in the second fixed die 6, both second punch rollers 7X and 7Y are disposed in such a manner as to oppose each other with the stay portion 32 located at the substantially intermediate position. The arrangement provided is such that the second movable die 8Y with the second punch roller 8Y is additionally provided for the second press B of the first embodiment at a position below the stay portion 32 in the set state.

The working of the recessed portion 2 using the above-described press apparatus for working the recessed portion 2 is effected as follows, for example.

Figure 11:
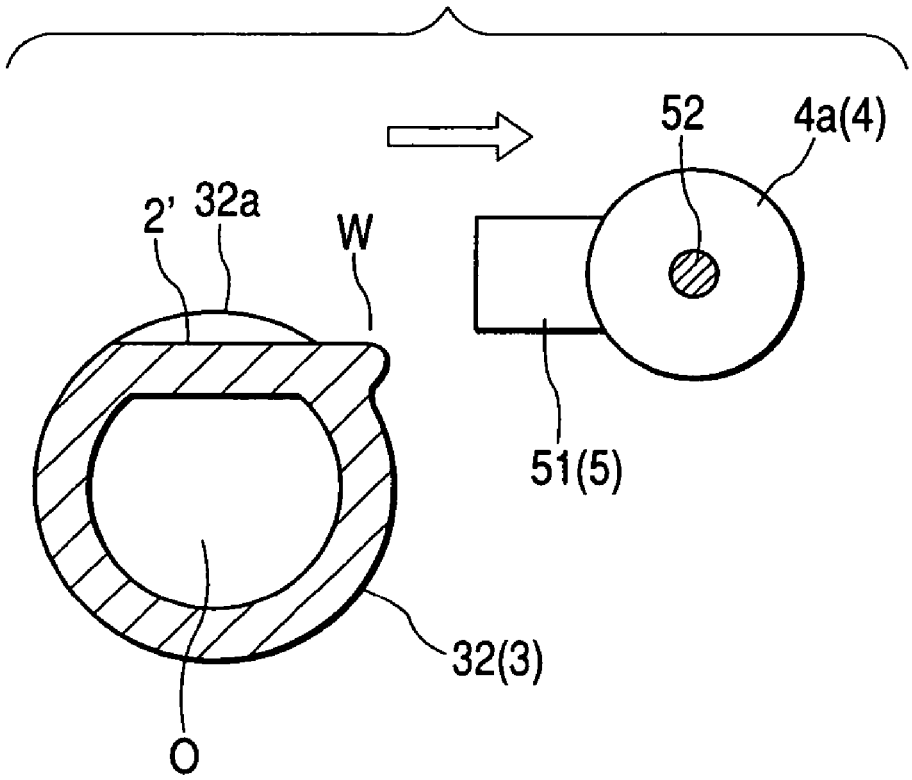
FIG. 11 is an explanatory diagram of a case in which defective deformation occurs.
Figures 12A, 12B, 12C:
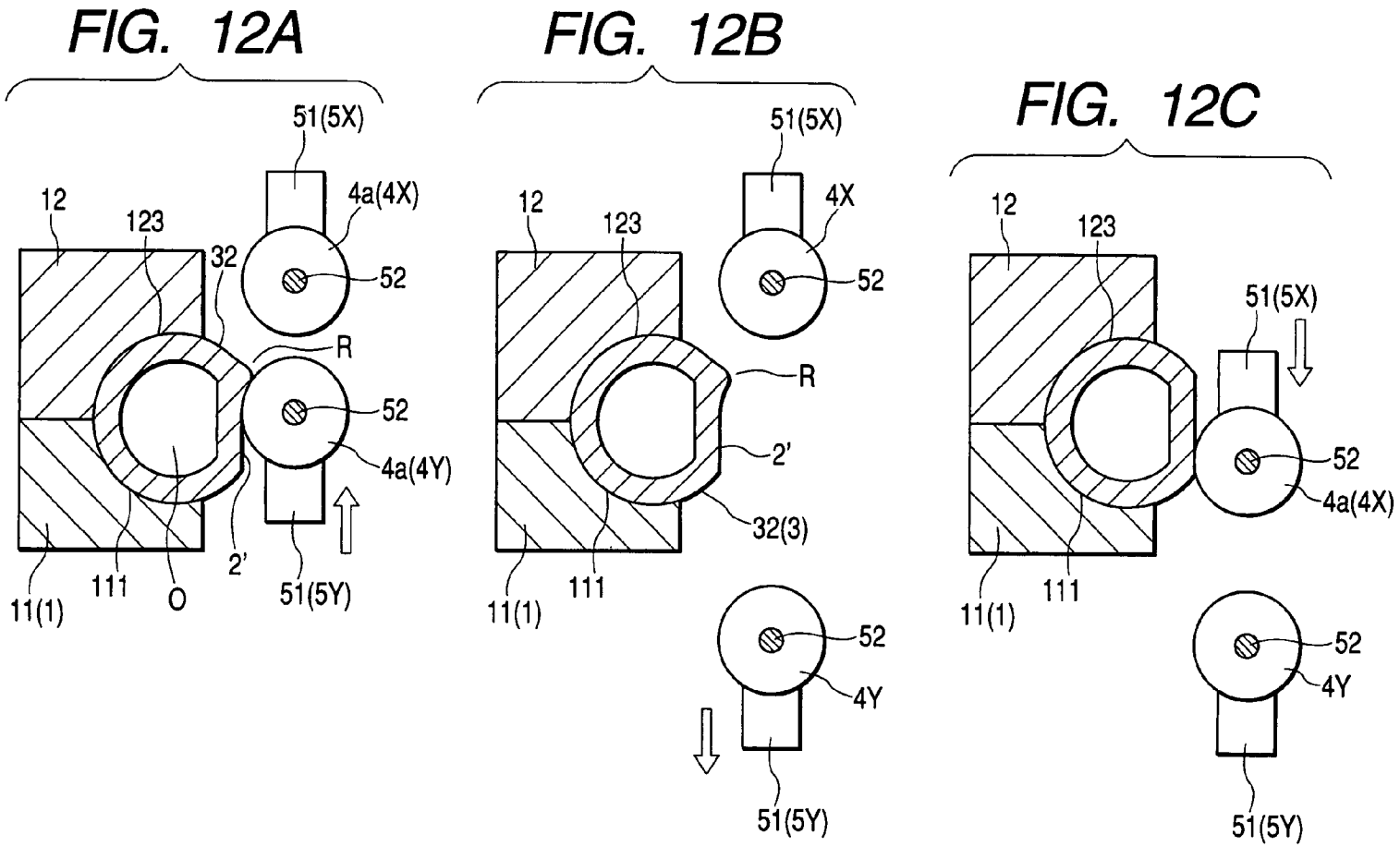
FIGS. 12(*a*)-12(*c*) are explanatory cross-sectional views illustrating a state in which the recess is formed by the first press.

First, either one (here, the lower one 4Y) of the aforementioned first punch rollers 4 which are arranged at positions above and below the stay portion 32 is set in a rotatable state, and is pressed against the stay portion 32 to start the working of the recess 2'. Then, the plastic working of the recess 2' proceeds, but the working of the recess is stopped just before the first punch roller 4Y traverses the stay portion 32, as shown in FIG. 12A. This is because if the first punch roller 4Y completely traverses the stay portion 32, burrs and the defective deformation W can occur in the working of the recess depending on the material and the like of the headrest stay 3, as shown in FIG. 11.

Subsequently, the first punch roller 4Y is retracted (FIG. 12B). Then, the other first punch roller 4 (here, the upper one 4X) is set in the rotatable state, and is pressed against the stay portion 32 partially provided with the working of the recess, so as to effect the preforming of the recess 2' (FIG. 12C). The first punch roller 4X which advances in the opposite direction to that of the previous first punch roller 4Y finely forms the recess 2' in such a manner as to push into the pipe interior a protruded portion R formed by the lower first punch roller 4Y. Here, if the first punch roller 4Y completely traverses the stay portion 32, there are cases where burrs and the defective deformation W jut out of the recess 2', and the deformation W remains even if the subsequent forming by the first punch roller 4X is effected. In that case, correction of the burrs and the like would be ultimately required in post processing. However, by effecting preforming as described above, it is totally unnecessary to effect the deburring operation and the like.

Figures 13A, 13B, 13C:
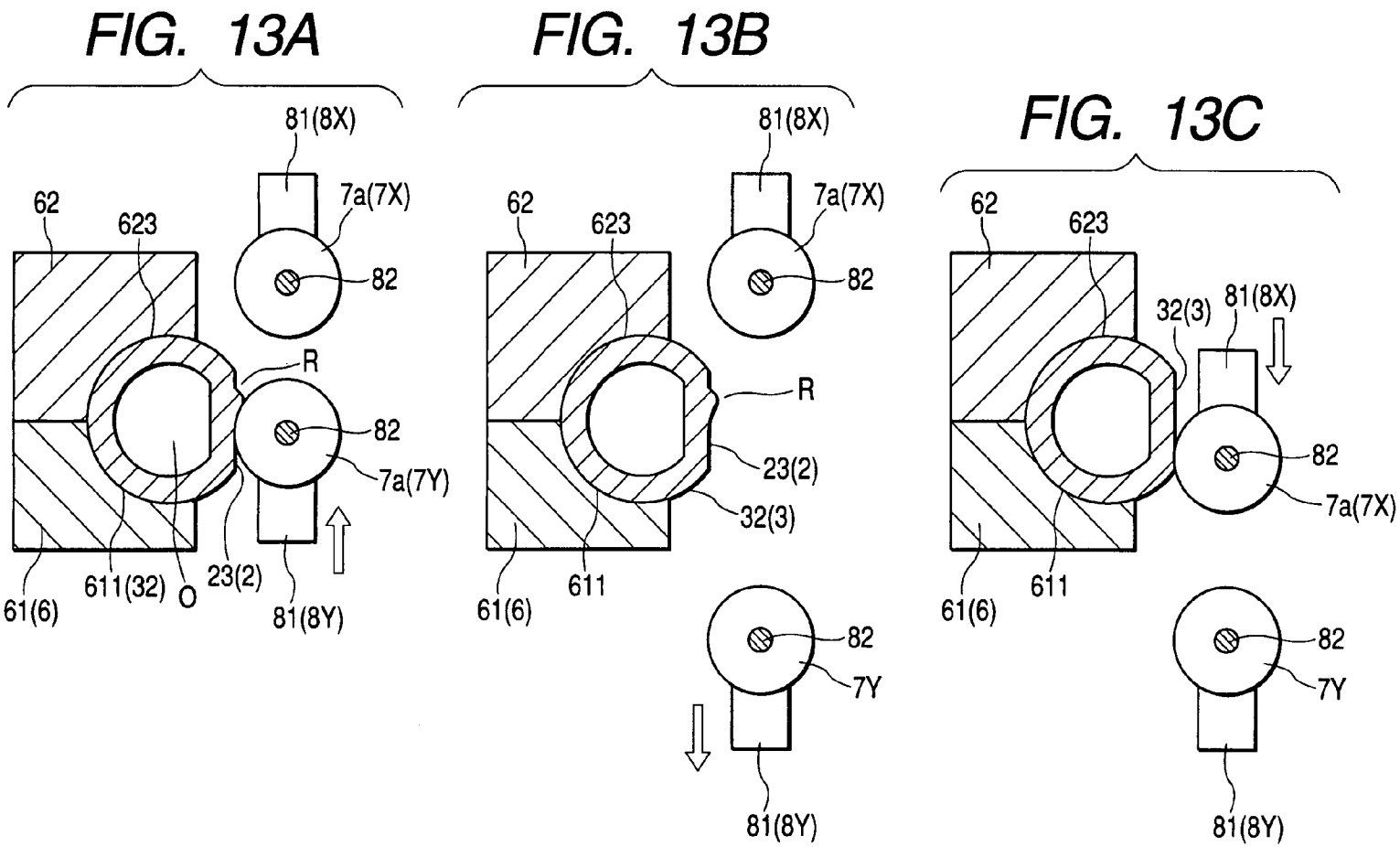
FIGS. 13(*a*)-13(*c*) are explanatory cross-sectional views illustrating a state in which the recessed portion is formed by the second press.

Next, the headrest stay 3 in which the recess 2' has been formed is set in the second fixed die 6, and the outer peripheral portion 7*a* of the second punch roller of the second press B is pressed against the recess 2' to form the recessed portion 2 (FIGS. 13A to 13C).

In this embodiment, in the forming of this recessed portion 2 as well, by using the second punch rollers 7X and 7Y which are arranged at positions above and below the stay portion 32, either one (the lower one 7Y) of the second punch rollers 7 is first pressed against the recess 2' to start the plastic working of the recessed portion 2 (FIG. 13A). Subsequently, the working of the recessed portion is stopped short of traversing the stay portion 32, and the second punch roller 7Y is retracted (FIG. 13B). Then, the other second punch roller 7 (here, the upper one 7X) is set in the rotatable state, and is pressed against the stay portion 32 partially provided with the recessed portion 2, so as to effect the final forming of the recessed portion 2 (FIG. 13C). Even after the preforming of the recess 2' has been effected, there are cases where a slight protruded portion R accompanying the work is formed, as shown in FIG. 13A. It is possible to completely obviate the post processing of deburring and attain improvement of the quality by stopping the working of the recessed portion just before the second punch roller 7Y traverses the stay portion 32 and by subsequently forming the recessed portion 2 by lowering the second punch roller 7X on the upper side in the opposite direction in such a way as to rub down the protruded portion R by the punch roller 7X.

Figure 14:
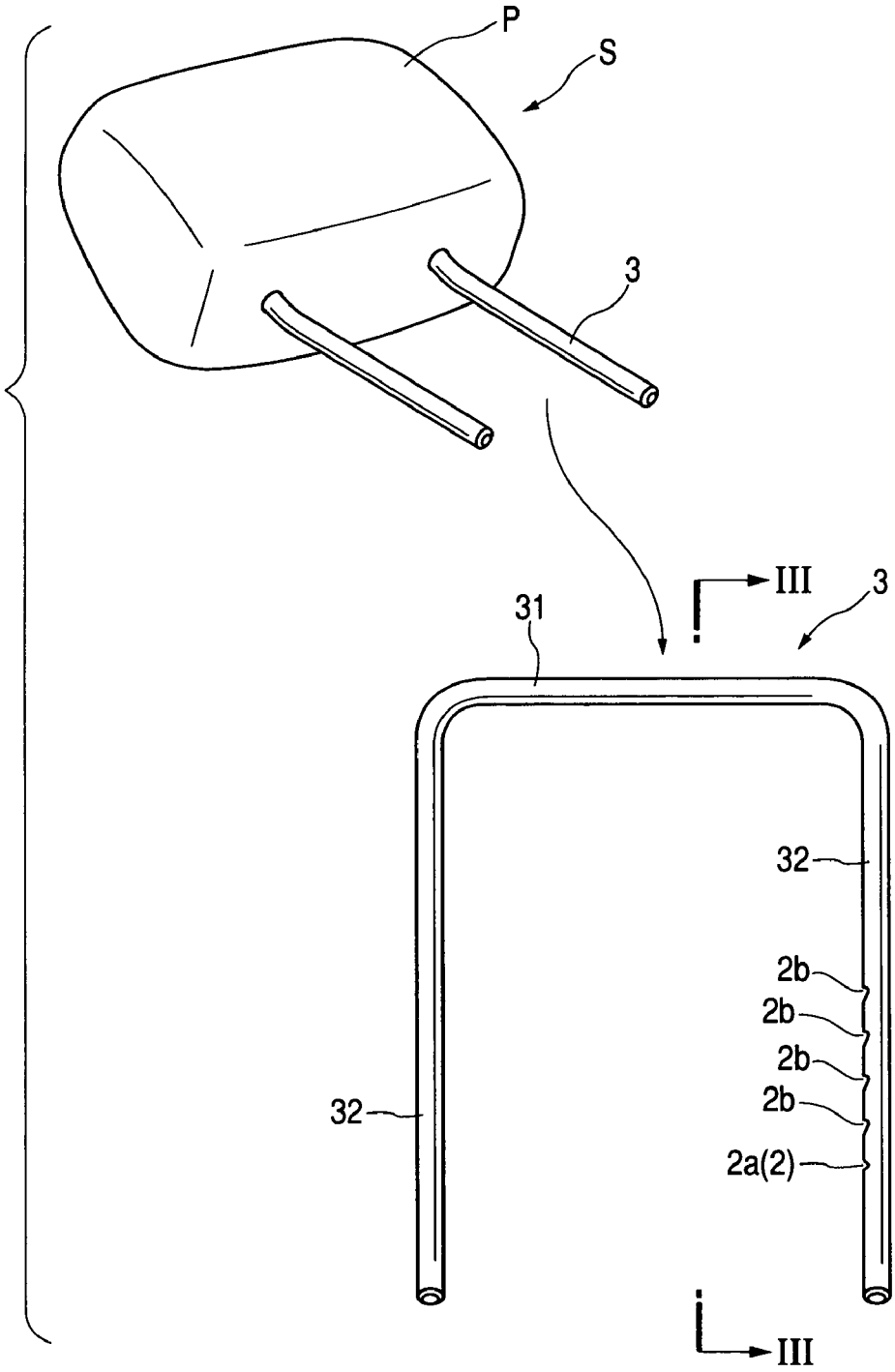
FIG. 14 is a perspective view of the headrest incorporating the headrest stay with recessed portions in which the recessed portions have been formed.
Figure 15:
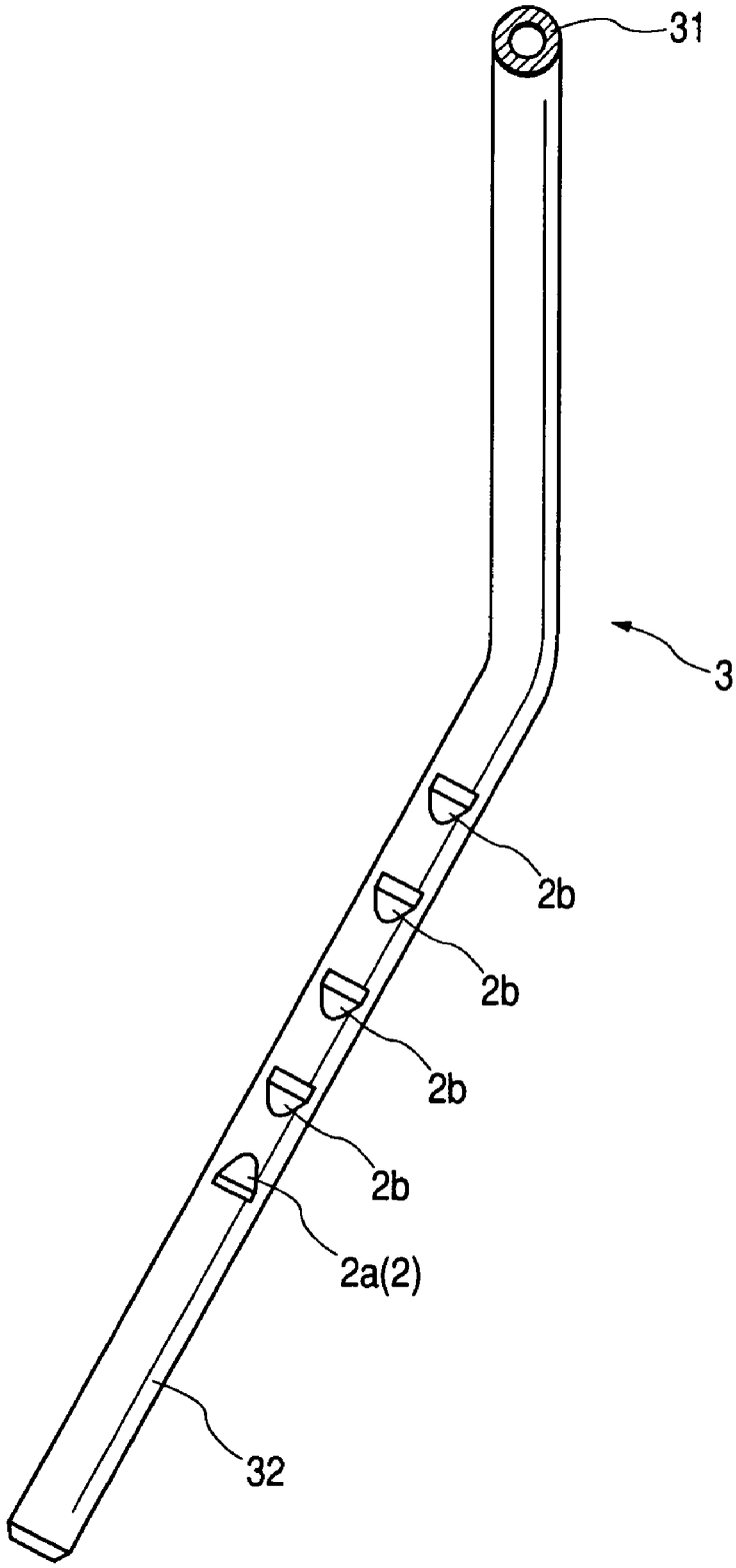
FIG. 15 is a view taken in the direction of arrows along line III-III in FIG. 14.
Figure 16A:
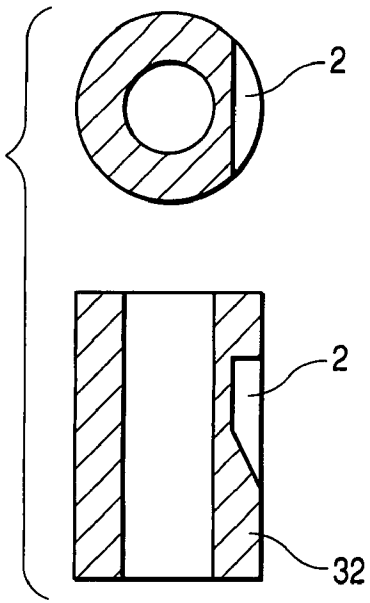
FIGS. 16(*a*)-16(*d*) are explanatory diagrams of the conventional art.
Figure 16B:
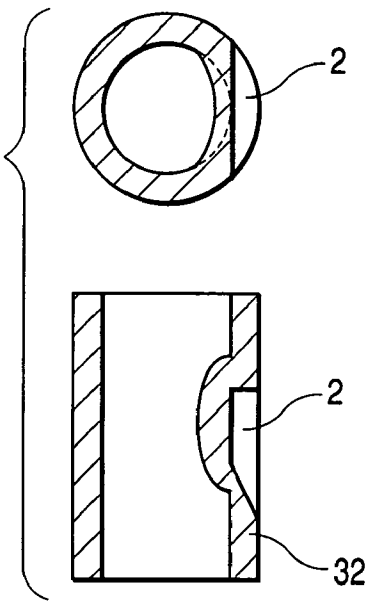
Figure 16C:
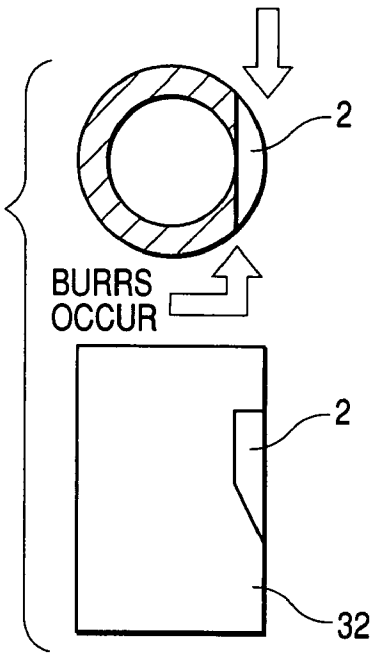
Figure 16D:
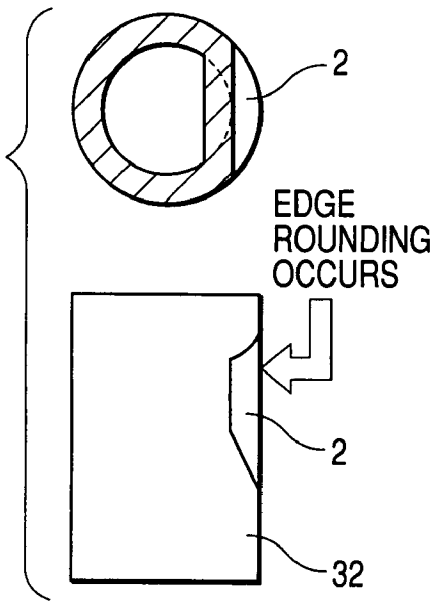

Thus, the headrest stay 3 in which the desired recessed portion 2 has been formed is completed. Although in the first and second embodiments a detailed description has been given of the recessed portion 2*a* for preventing the headrest stay from coming off (see FIG. 14), as for the retaining recessed portion 2*b* as well, only the shapes of the first punch rollers 4 and the second punch rollers 7 differ, and the same description holds true.

(3) Advantages

According to the method of working the recessed portion 2 in the headrest stay 3 arranged as described above, the recess 2' is obtained in the preforming using the first punch roller 4 without effecting cutting work. Further, the recessed portion 2 of the final shape can be formed by the subsequent second punch roller 7 without effecting cutting work. Therefore, no chips are produced. This not only leads to the improvement of the operating efficiency, but it is possible to sufficiently secure the wall thickness t similar to that of the remaining stay portion 32. Thus the recessed portion 2 is able to sufficiently perform its role of mechanical strength which is the holding function necessary for the height adjustment of the stay portion 32. It becomes unnecessary to enlarge the wall thickness of the pipe, which has been the conventional case based on cutting work.

In addition, since the preforming of the recessed portion 2 is effected by pressing against the stay portion 32 while rotating the first punch roller 4 by using the headrest stay 3 formed of a pipe, the recess 2' is formed in which the pipe wall t is efficiently pressed into the pipe interior O, and no burrs are produced. Since the first punch roller having the rounded portion 47 on its outer peripheral portion 4*a* in a side view is adopted, no deformation occurs at an unnecessary portion when the recess 2' is formed.

Then, since the desired recessed portion 2 is finished by press working by means of the second punch roller 7 concerning the second press B, the upright surface 21 of the recessed portion 2 can be formed into a steeply rising, sharp vertical surface which is capable of sufficiently demonstrating its retaining function. The approximate shape of the recessed portion 2 is fabricated in preforming in the first stage, so that burrs, edge rounding, and the like do not occur.

Furthermore, as in the second embodiment, the first punch rollers 4X and 4Y are arranged at positions above and below the stay portion 32, either one of them is set in a rotatable state, and the working of the recess 2' is started by pressing against the stay portion 32. Subsequently, the working of the recess is stopped short of traversing the stay portion 32, and that first punch roller 4 is retracted. Then, the other first punch roller 4 is set in the rotatable state, and is pressed against the stay portion 32 partially provided with the working of the recess, so as to effect the preforming of the recess 2'. If such an arrangement is provided, the working of the recessed portion of high quality with high precision can be performed. Moreover, the operation of deburring and the like can be completely eliminated, and manufacturing with ease and at low cost is made possible. As for the second punch rollers 7 as well, these punch rollers are arranged at positions above and below the stay portion 32, and either one of them is first pressed against the recess 2' to start the working of the recessed portion 2. Subsequently, the working of the recessed portion is stopped short of traversing the stay portion 32, and the second punch roller 7 is retracted. Then, the other second punch roller 7 is set in the rotatable state, and is pressed against the stay portion 32 partially provided with the working of the recessed portion, so as to form the recessed portion 2. If such an arrangement is provided, a more satisfactory recessed portion worked product can be obtained. In addition, the first press A and the second press B differ only in the punch rollers 4 and 7, and the other component elements are products of the same shapes, so that the apparatus of the invention can be fabricated at relatively low cost.

It should be noted that the invention is not confined to the one shown in the above-described embodiments, and various modifications are possible within the range of the invention in accordance with the purpose and application. The shapes, sizes, materials, and the like of the first press A, the second press B, and their component elements, and the like may be selected appropriately within the range of the invention in accordance with the application. Although in the embodiments the first and second punch rollers 4 and 7 are respectively attached rotatably to the first-and second-punch-roller mounting tools 51 and 81, the first and second punch rollers 4 and 7 are set in the rotatable state so as to form the recess 2' or the recessed portion 2. However, an arrangement in which the first and second punch rollers 4 and 7 are actively rotated by motors or the like and are pressed against the stay portion 32 to form the recess 2' or the recessed portion 2 also falls within the range of the invention.

As described above, the method of working a recessed portion in a headrest stay and the press apparatus for working a recessed portion in a headrest stay in accordance with the invention is extremely effective in that it is possible to secure necessary wall thickness without producing any chips and obtain a recessed portion having a sharp shape.

(3) Third Embodiment

Figure 17A:
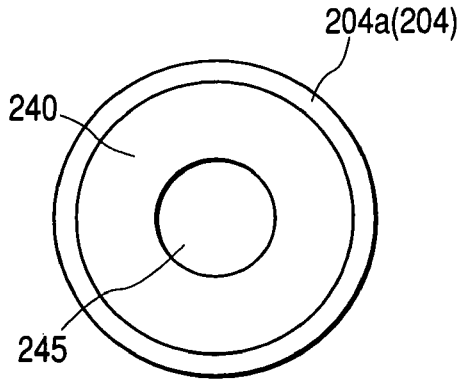
FIGS. 17A and 17B are enlarged views of a punch shown in FIG. 1.
Figure 17B:
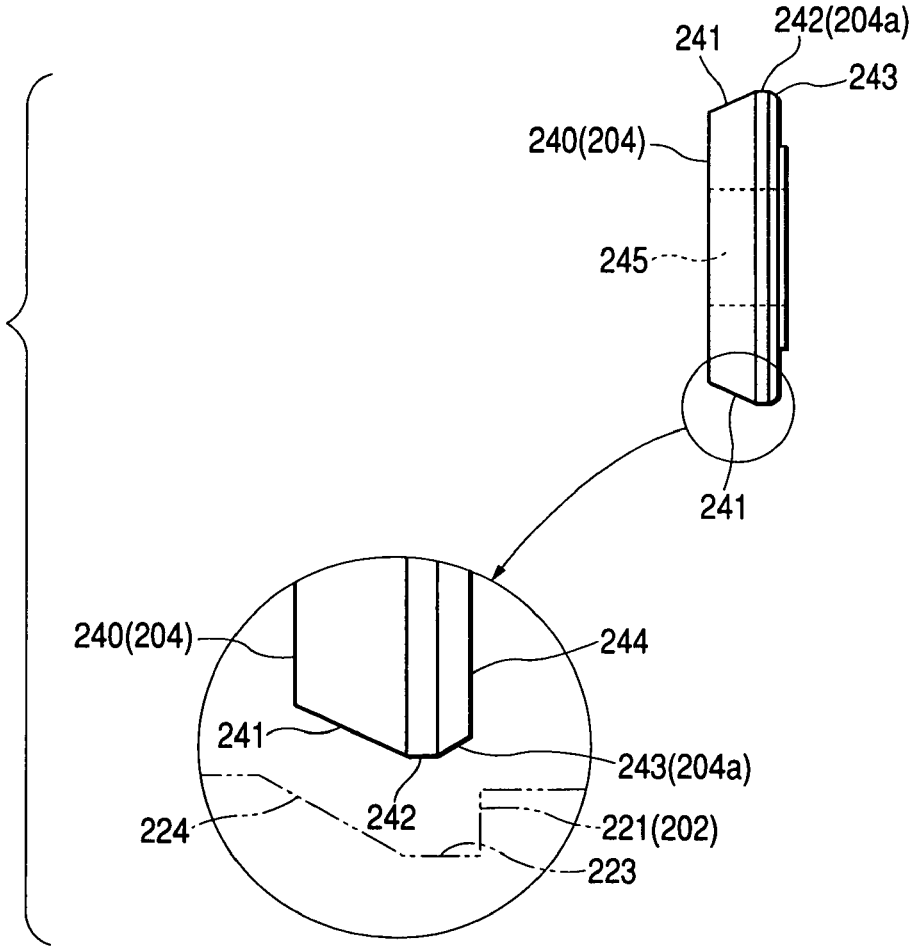
Figure 18A:
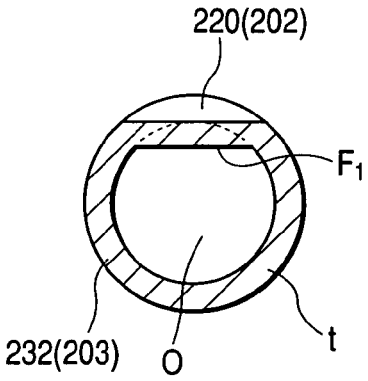
FIGS. 18A and 18B are enlarged views of a recessed portion and its vicinity after completion of preforming.
Figure 18B:
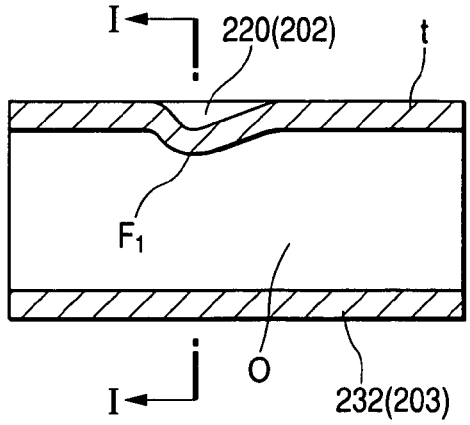
Figure 19:
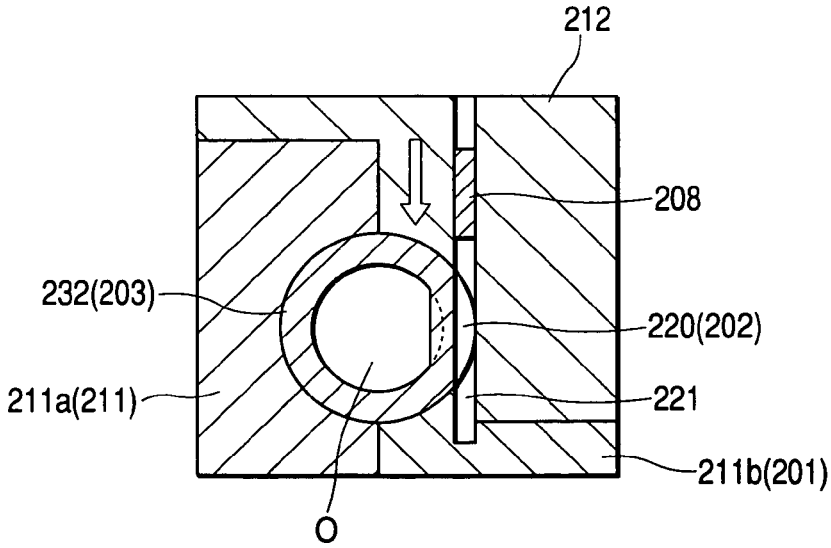
FIG. 19 is an explanatory cross-sectional view of a press working apparatus for a second step.
Figure 20:
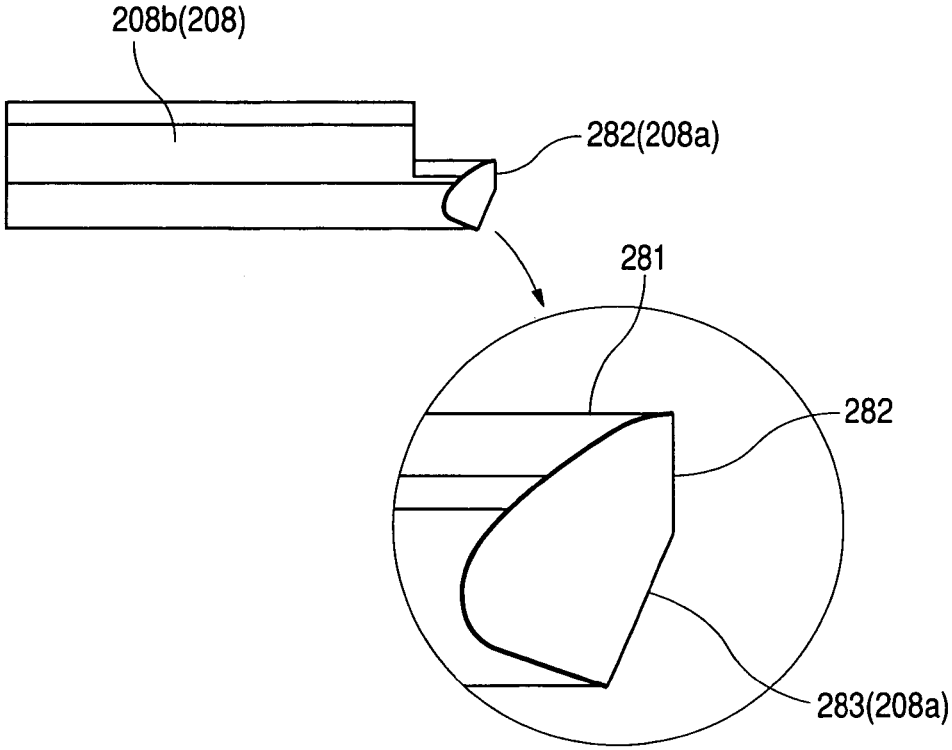
FIG. 20 is an enlarged view of a press punch shown in FIG. 19.
Figure 21:
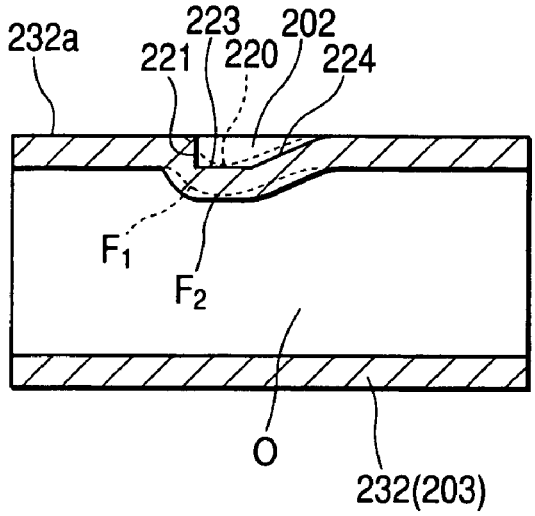
FIG. 21 is an explanatory cross-sectional view of the recessed portion and its vicinity concerning a stay portion in which the recessed portion and its vicinity after the first step and the recessed portion and its vicinity after the second step are overlapped.
Figure 22:
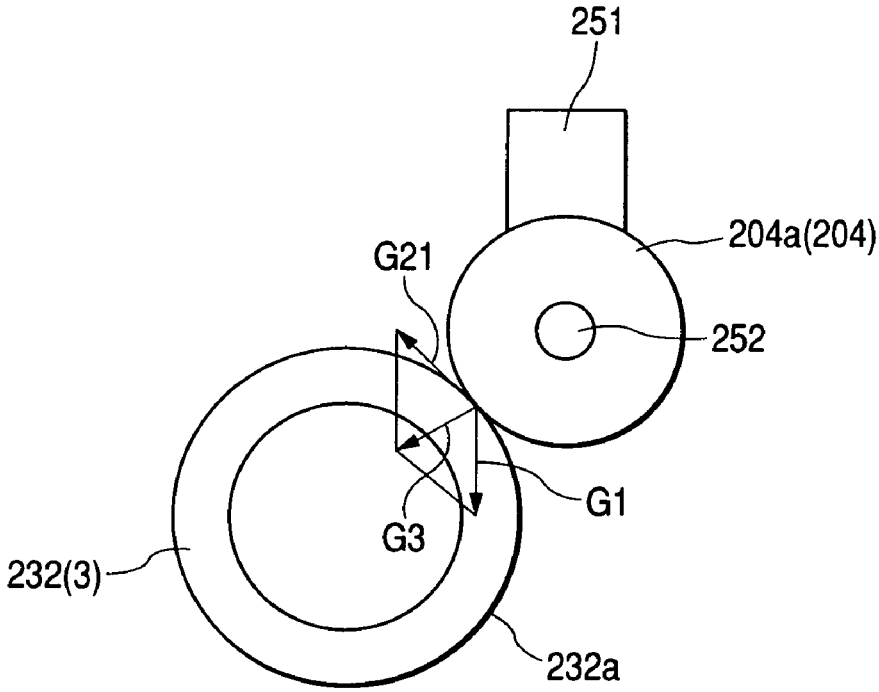
FIG. 22 is an explanatory diagram illustrating the direction of a resultant force produced by the centrifugal force relating to the rotating force and by the pressing force.

Hereafter, a detailed description will be given of a method of working a recessed portion in a headrest stay in accordance with the invention. FIGS. 17 to 22 show the third mode of the method of working a recessed portion in a headrest stay in accordance with the invention. FIGS. 17A and 17B are enlarged views of a punch shown in FIG. 1. FIGS. 18A and 18B are enlarged views of a recessed portion and its vicinity after completion of preforming. FIG. 19 is an explanatory cross-sectional view of a press working apparatus for a second step. FIG. 20 is an enlarged view of a press punch shown in FIG. 19. FIGS. 9A and 9B are enlarged views of the recessed portion and its vicinity after the second step. FIG. 21 is an explanatory cross-sectional view in which the recessed portion and its vicinity after the first step and the recessed portion and its vicinity after the second step are overlapped. FIG. 22 is an explanatory diagram illustrating the direction of a resultant force produced by the centrifugal force relating to the rotating force and by the pressing force in a case where the rotating punch is pressed and lowered against a stay portion.

Prior to the method of working a recessed portion in a headrest stay in accordance with the invention, a description will be first given of a recessed portion working apparatus which is used in this method. The working apparatus is comprised of a punch 204 for a first step and a press punch 208 for a second step while jointly using a holder 211 which is a lower die for holding and fixing a headrest stay 203.

The aforementioned punch 204 is a disk resembling the recessed portion 202 for determining the side-view shape of an outer peripheral portion, and is supported by a rotating shaft 252 of a punch mounting tool 251. The punch mounting tool 251 normally stays on standby at a position above that portion of the stay portion 232 (which has been set in the holder 211) where the recessed portion 202 is provided. Then, as the punch mounting tool 251 is lowered while rotating the punch 204 clockwise, as shown in FIG. 1, the stay portion 232 is pressed by the punch 204, thereby permitting the preforming of the recessed portion 202.

Enlarged views of the punch 204 are shown in FIGS. 17A and 17B. FIG. 17A is a front elevational view of the punch 204, and FIG. 17B is a side elevational view of the punch 204. A side-view shape of the recessed portion 202, which is similar to the shape of the recessed portion to be finally obtained, but is slightly smaller than that shape, is secured on the outer peripheral portion of the punch 204. As shown in the in-circle enlarged view in FIG. 17B, an inclined surface 241 corresponding to an inclined surface 224 of the recessed portion 202 is provided on an outer peripheral portion 204*a* of the punch, and a flat surface 242 corresponding to a bottom surface 223 of the recessed portion and a corner sheared surface 243 are provided. Because the punch 204 is rotated, and the corner sheared surface 243 is provided, a dent 220 for preforming the recessed portion 202 can be worked easily.

The press punch 208 in the second step is a device for forming the recessed portion 202 of the final shape by subjecting the aforementioned dent 220 to press working (FIG. 19). The press punch 208 is arranged to be built on a holder cover 212 which is fitted on the holder 211. The holder cover 212 which is on standby in the upper position in the first step is lowered and is fitted on the cover in the second step. A passage 221 for the press punch is vertically formed in the holder cover 212. As the holder cover 212 is fitted on the holder 211, the passage 221 which vertically extends through the portion of the dent 220 is formed. As the press punch 208 is disposed in the passage 221 and is passed therethrough, it is thereby possible to work a sharp recessed portion 202 whose upright surface 221 is perpendicular to the peripheral surface of the pipe. A cutting edge portion 208*a* for the recessed portion is formed on the portion of the press punch 208 which is lowered and passed through the passage 221, as shown in FIG. 20. As shown in the in-circle enlarged view shown in FIG. 20, the shape of the projection formed by an upright-surface forming portion 281, a bottom-surface forming portion 282, and an inclined-surface forming portion 283 of the cutting edge portion 208*a* of the press punch is substantially equal to the shape of the recessed portion to be obtained. In FIG. 20, reference numeral 208*b* denotes a chuck portion.

In the method of working a recessed portion in a headrest stay, the headrest stay 203 formed of a pipe is first set in the holder 211 (FIG. 1). After the left and right split dies 11*a* and 211*b* are opened, and the stay portion 232 is fitted, the stay portion 232 is fixed and set by closing the dies. At this time, the right half portion of the stay portion 232 which is a portion M where the recessed portion 202 is to be provided is in an exposed state.

Next, as the first step, the rotating shaft 252 is started and, while rotating the punch 204, the punch mounting tool 251 is lowered to the recessed-portion forming portion M of the stay portion 232. While the punch 204 jutting out from the mounting tool is being rotated, the punch 204 is pressed against the stay portion 232 to effect the preforming of the recessed portion 202.

As already mentioned, the punch 204 is a disk, and the side-view shape of its outer peripheral portion is made similar to that of the recessed portion 202. The disk of the punch 204 is lowered toward the recessed-portion forming portion M perpendicularly to the longitudinal direction of the stay portion 232, thereby effecting the preforming of the recessed portion 202.

Since the punch 204, while rotating, presses the stay portion 232, it is possible to effect preforming in which unnecessary deformation of the pipe (stay portion 232) is suppressed. Here, it is more preferable if the rotating punch 204 is set so as to apply a force in the direction in which a pipe wall t is pressed toward a pipe interior O. Specifically, as viewed in FIGS. 1 and 22, a resultant force G3 of a force G1 acting in the direction of the open arrow in which the punch 204 is lowered and a force G2 with which the punch 204 rotates clockwise in the direction of the solid arrow acts to apply a force in the direction in which the pipe wall t is pressed toward the pipe interior O. When the force G1 for lowering the punch 204 and a centrifugal force G21 relating to the clockwise rotating force G2 of the punch 204 are applied to the recessed-portion forming portion M, the resultant force G3 thereof becomes a force which tends to enter the pipe interior, as shown in FIG. 22. It should be noted that the hatching of the pipe section of the stay portion 232 is omitted in FIG. 22. If the punch 204 is rotated clockwise in FIG. 1, unnecessary deformation is made difficult to occur in the pipe as compared with the case where the rotating direction of the punch 204 is counterclockwise even if the punch 204 is likewise rotated. In fact, it is confirmed that if the recessed portion 202 is preformed by lowering the punch 204 while rotating the punch 204 clockwise in FIG. 1, only the necessary dent 220 for the recessed portion could be formed without the occurrence of deformation in an unnecessary portion.

It should be noted that, as for the direction of the aforementioned resultant force when the punch 204 comes into contact with the peripheral surface corresponding to the recessed-portion forming portion M of the stay portion 232, if that direction passes the central axis of the pipe, it is considered most effective in the formation of the recessed portion. This being the case, in view of the rotating force for generating the centrifugal force of the punch 204, it is favorable to press and lower the punch 204 against the recessed-portion forming portion M at a relatively fast speed corresponding to that rotating force.

Since the outer peripheral portion 204*a* of the punch presses the recessed-portion forming portion M of the stay portion 232 while rotating, the force G3 which is directed toward the pipe interior, as shown in FIG. 22, is applied to the pipe 232. However, since the interior of the pipe is hollow at O, the force is satisfactorily dodged and absorbed while denting the pipe at 220 toward the pipe interior. The pipe wall t need not be shaved off, and no apprehension is caused over the occurrence of cracks or the like in the basic material of the pipe. Thus, when the punch 204 which is rotating while being pressed against the stay portion 232 passes that recessed-portion forming portion M, the preformed dent 220 is formed, as shown in FIGS. 18A and 18B. As the dent 220 is formed, a bulged portion F1 is formed on the inner peripheral side of the stay portion at the recessed-portion forming portion M. FIG. 18A shows a cross-sectional view of the stay portion, and FIG. 18B shows a longitudinal sectional view of the stay portion.

As for the outer peripheral portion of the punch 204, a side-view shape which is slightly smaller than that of the recessed portion 202 is adopted, as already mentioned, and the dent 220 which is close to the recessed portion 202 is obtained, as shown in FIGS. 18 and 21. However, it is desirable that the dent 220 be as close to the shape of the finally obtained recessed portion 202 as possible. This is because, in this embodiment, shaving is adopted as the second step, so that the smaller the machining allowance, the more satisfactory result can be obtained.

When the aforementioned dent 220 has been formed, the punch 204 is then retracted in a state in which the holder 211 for fixing and holding the stay portion 232 is left as it is. Subsequently, the holder cover 212 is fitted on the holder 211 (FIG. 19).

Subsequently, the final recessed portion 202 is formed by press working using the press punch 208. Shaving is adopted as the press working in this step, as described above. Generally, shaving is a process in which a sheared surface is shaved by the press punch, and a smooth sheared surface of high precision is said to be obtained. In the invention, the dent 220 corresponding to the shape of the recessed portion 202 is shaved by its machining allowance by the press punch 208, thereby securing a sheared surface of high precision. It goes without saying that, unlike normal punching using the press punch 208, since the stay portion 232 is formed of the pipe, part of the force of the press punch 208 is absorbed while denting the stay portion 232 toward the pipe interior at 220 in the process of punching with the press punch 208. Accordingly, after press punching is over, a portion F2, which is bulged slightly larger than the bulged portion F1 formed by punching, is formed on the inner peripheral side of the stay portion at the recessed-portion forming portion M (FIG. 21).

In shaving, the recessed portion 202 is formed in a form in which the upright-surface forming portion 281 of the cutting edge portion 208*a* is stood upright on the outer peripheral surface of the stay portion 232 perpendicularly to the outer peripheral surface 232*a* of the stay portion 232. The steeply rising upright surface 221 is formed, making it possible to exhibit the function of the stopper. In addition, since a corner is formed where the upright-surface forming portion 281 and the bottom-surface forming portion 282 of the cutting edge portion 208*a* meet at right angles, the portion where the upright surface 221 and the bottom surface 223 of the recessed portion 202 meet is finished to a sharp shape which is substantially free of a curved surface.

Thus, the machining allowance of the dent 220 is removed by punching with the press punch 208 (FIG. 19). Although part of the machining allowance is shaved off, the remaining portion is dented toward the pipe interior and thereby assumes a form obtained just as if the machining allowance has been removed. Since the dimensions of the projection of the cutting edge portion 208*a* of the press punch 208 are set substantially equal to the dimensions of the recessed portion 202 (FIG. 20), the desired recessed portion 202 is formed by shaving using the press punch 208, as shown in FIGS. 9A, 9B, and 21.

According to the method of working a recessed portion in a headrest stay arranged as described above, since the dent 220 which is close to the recessed portion 202 can be obtained by the preforming using the punch 204 without effecting cutting work, the machining allowance to be shaved in the stage of finishing the shape of the recessed portion by the subsequent press working can be very small. The wall thickness t can be secured sufficiently even at the recessed portion 202, and even if the recessed portion 202 having the height adjusting function is formed in the stay portion 232, the stay portion 232 is able to perform its function of holding. It becomes unnecessary to make the pipe wall thickness large, which has been required in the conventional case based on cutting work.

In addition, since the preforming of the recessed portion 202 is effected by pressing the stay portion 232 while rotating the punch 204 by using the headrest stay 203 formed of a pipe, it is possible to form the dent 220 for the recessed portion in which the pipe wall t is efficiently pressed toward the pipe interior O, and burrs do not occur. When the dent 220 for the recessed portion is formed, deformation does not occur at an unnecessary portion.

Further, since the desired recessed portion 202 is formed by press working by the press punch 208, the recessed portion 202 can be formed into a sharp shape in terms of the retaining function required for the recessed portion 202. Since most of the shape of the recessed portion 202 is formed by preforming in the first step, edge rounding and the like do not occur. Furthermore, if shaving by means of the press punch 208 is adopted as in the embodiment, it is possible to obtain the recessed portion 202 of high precision. Moreover, the operation such as deburring is not required, and manufacturing with ease at low cost is made possible.

In addition, since forming is two-stage forming, the press forming time of each stage can be shortened. In addition, since the operation proceeds to the press working of the second step in the same press equipment by using the holder 211 for preforming in the first step as it is, it is possible to attain a reduction of the total forming time even if it is two-stage forming.

It should be noted that the invention is not limited to the above-described embodiment, and various modifications are possible within the range of the invention in accordance with the purpose and application. The shapes, sizes, materials, and the like of the holder 211, the holder cover 212, the recessed portions 202, the headrest stay 203, the punch 204, the press punch 208, and the like may be selected appropriately within the range of the invention in accordance with the application. Although in the embodiment shaving is adopted as press working using the press punch, shaving is one example, and the invention is not limited to the same.

As described above, the method of working a recessed portion in a headrest stay in accordance with the invention exhibits outstanding advantages in that it is possible to obtain a sharp shape of the recessed portion while securing necessary wall thickness, and that it is possible to provide a recessed portion having a sharp shape easily at low cost.

What is claimed is:

1. A method of working a recessed portion in a headrest stay which is provided in a stay portion of said headrest stay formed of a pipe, comprising the steps of:

preforming a recess by rotatingly pressing against said stay portion an outer peripheral portion of a first punch roller for preforming having a rounded portion on the outer peripheral portion in a side view; and directing toward and rotatingly pressing against said recess an outer peripheral portion of a second punch roller on the outer periphery portion of which a punch portion for final forming has been formed, so as to form a recessed portion, wherein the outer peripheral portion of said first punch roller is asymmetrical, further including an inclined surface which slopes downward toward the rounded portion, and wherein the outer peripheral portion of said second punch roller is asymmetrical, further including an inclined surface which slopes downward toward the punch portion, and wherein the punch portion includes a vertical portion and a flat portion which intersect at a right angled portion.

* * * * *